US009761963B1

(12) United States Patent
Matsumoto

(10) Patent No.: US 9,761,963 B1
(45) Date of Patent: Sep. 12, 2017

(54) CONNECTOR

(71) Applicant: Japan Aviation Electronics Industry, Limited, Tokyo (JP)

(72) Inventor: Masakazu Matsumoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/454,464

(22) Filed: Mar. 9, 2017

(30) Foreign Application Priority Data

Jun. 8, 2016 (JP) ..... 2016-114735

(51) Int. Cl.
*H01R 9/05* (2006.01)

(52) U.S. Cl.
CPC ..... *H01R 9/0527* (2013.01); *H01R 9/0524* (2013.01)

(58) Field of Classification Search
CPC ..... H01R 9/0527; H01R 9/0524; H01R 9/05; H01R 9/0518; H01R 9/031; H01R 4/203; H01R 4/2495; H01R 4/54; H01R 24/40
See application file for complete search history.

(56) References Cited

U.S. PATENT DOCUMENTS 4,280,749 A * 7/1981 Hemmer ..... H01R 24/40 174/89
6,089,912 A * 7/2000 Tallis ..... H01R 9/05 439/583
7,416,448 B2 * 8/2008 Gaidosch ..... H01R 9/031 439/607.41
2003/0224656 A1 * 12/2003 Yoshida ..... H01R 9/0518 439/578
2006/0216998 A1 * 9/2006 Morikawa ..... H01R 9/053 439/877
2011/0008999 A1 * 1/2011 Annequin ..... H01R 24/54 439/582
2014/0134873 A1 * 5/2014 Lehmann ..... H01R 4/2495 439/421
2014/0150259 A1 * 6/2014 Lehmann ..... H01R 4/203 29/857

FOREIGN PATENT DOCUMENTS

JP 1-124669 U 8/1989

* cited by examiner

*Primary Examiner* — Jean F Duverne
(74) *Attorney, Agent, or Firm* — Muncy, Geissler, Olds & Lowe, P.C.

(57) ABSTRACT

A connector includes an inner sleeve through which a central conductor and an insulator of a coaxial cable are passed and an outer sleeve through which the central conductor, the insulator and a shield member of the coaxial cable are passed, the inner sleeve including projection portions that are arranged in a circumferential direction, project outward in a radial direction and are inserted between the insulator and the shield member of the coaxial cable, and at least one of the projection portions is elastically displaceable in the radial direction, the outer sleeve including an inner peripheral surface that covers the projection portions and tapers in a first direction directed toward the front end of the coaxial cable along the coaxial cable, the shield member of the coaxial cable being sandwiched between the projection portions of the inner sleeve and the inner peripheral surface of the outer sleeve.

8 Claims, 3 Drawing Sheets

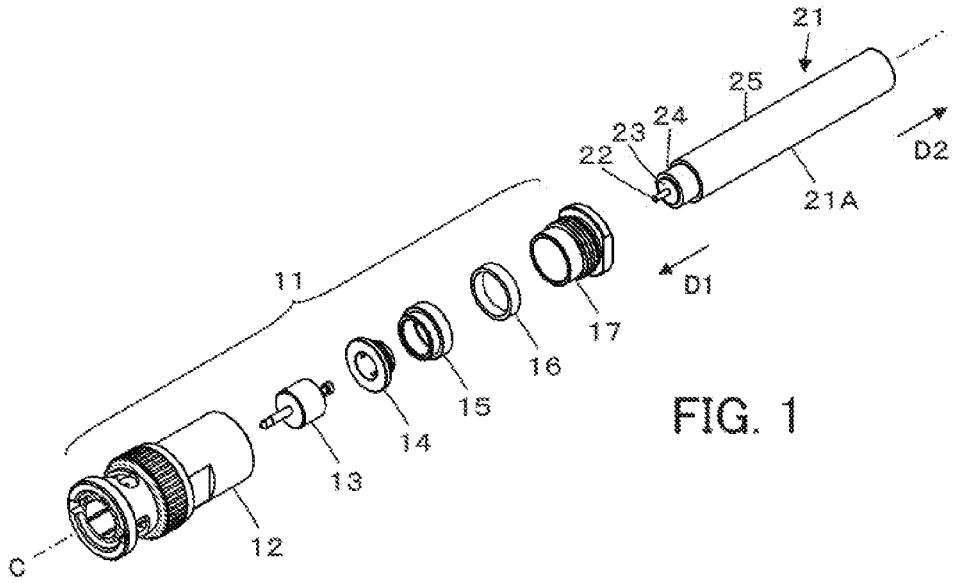
FIG. 1
FIG. 2
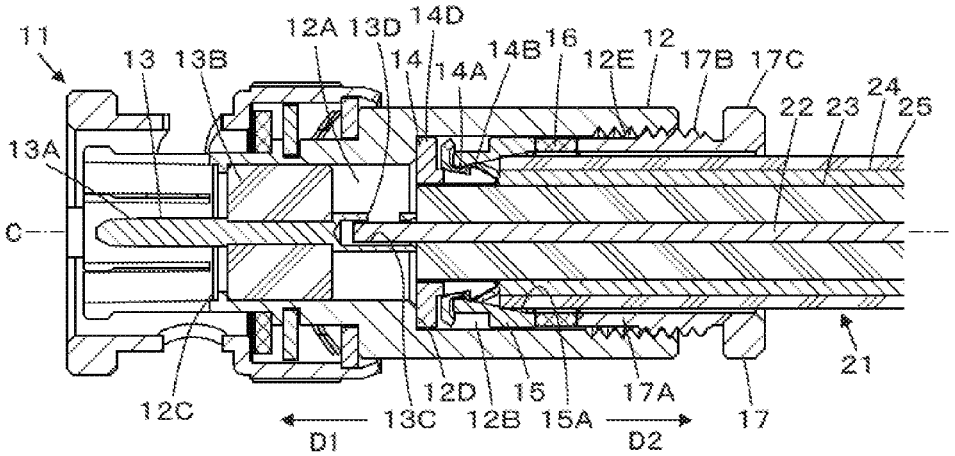
FIG. 3
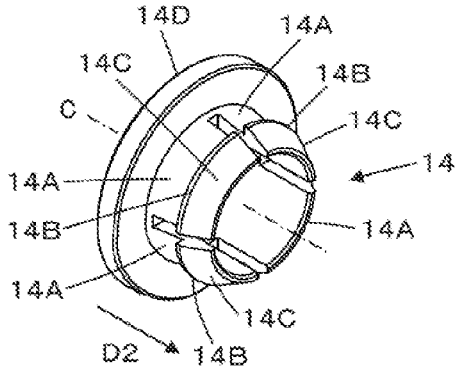

CONNECTOR

BACKGROUND OF THE INVENTION

The present invention relates to a connector, in particular, to a connector that is attached to an end portion of a coaxial cable.

A connector for connecting a coaxial cable has been conventionally used, and a connector 1 illustrated in FIG. 9 is disclosed by JP H1-124669 U, for example. The connector 1 includes a shell 3 with which a connection nut 2 is rotatably engaged and a fastening ring 4, while a coaxial cable 5 has a structure in which an outer periphery of a central conductor 6 is covered by an insulator 7, and an outer periphery of the insulator 7 is covered by a shield member 8 and a casing 9.

For attachment of the connector 1 to the coaxial cable 5, firstly, the coaxial cable 5 is passed through the fastening ring 4, a given length of the casing 9 at a front end of the coaxial cable 5 is removed, and thereafter the shield member 8 is folded back onto the outer periphery of the coaxial cable 5 such that the insulator 7 is exposed. In this state, a cylindrical portion 3A of the shell 3 of the connector 1 is inserted between the insulator 7 and the shield member 8 of the coaxial cable 5, and the fastening ring 4 is moved toward the connection nut 2 until coming into contact with the shell 3 as illustrated in FIG. 10 and is deformed and tightened by a tool (not shown), whereby attachment of the connector 1 is completed.

In this process, the shield member 8 and the casing 9 of the coaxial cable 5 are sandwiched between the cylindrical portion 3A of the shell 3 and the fastening ring 4 of the connector 1 and compressed in a radial direction of the coaxial cable 5 by the fastening ring 4. The connector 1 is held so as not to fall off from the coaxial cable 5 in this manner.

Meanwhile, since the cylindrical member 3A of the shell 3 of the connector 1 is inserted between the insulator 7 and the shield member 8 of the coaxial cable 5, the shield member 8 and the casing 9 form a slanted surface that becomes thicker toward the connection nut 2 of the connector 1, and from the above-described shield member 8 and the casing 9, an inner surface of the fastening ring 4 receives a normal force having a force component exerted in a direction away from the connection nut 2. Hence, there is a problem that the fastening ring 4 readily falls off during the process for attachment of the connector 1.

In addition, there arises another problem that the connector 1 enlarges when, in order to prevent the fastening ring 4 from falling off, the lengths of the cylindrical portion 3A of the shell 3 and the fastening ring 4 in an axial direction are increased for the larger compressed areas of the shield member 8 and the casing 9 to be pressed in the radial direction of the coaxial cable 5 by the fastening ring 4 and the increased friction force between the fastening ring 4 and the folded-back shield member 8.

SUMMARY OF THE INVENTION

The present invention has been made to eliminate the conventional problems as above and is aimed at providing a connector that is small in size, that does not readily fall off during the process for attachment of the connector, and that can be securely attached to an end portion of a coaxial cable.

A connector according to the present invention is one that is attached to a front end of a coaxial cable, the coaxial cable including a central conductor, an insulator covering an outer periphery of the central conductor and a shield member covering an outer periphery of the insulator, the connector comprises:

an inner sleeve through which the central conductor and the insulator of the coaxial cable are passed; and an outer sleeve through which the central conductor, the insulator and the shield member of the coaxial cable are passed, wherein the inner sleeve includes a plurality of projection portions that are arranged in a circumferential direction, project outward in a radial direction and are inserted between the insulator and the shield member of the coaxial cable, and at least one of the plurality of projection portions is elastically displaceable in the radial direction, wherein the outer sleeve includes an inner peripheral surface that covers the plurality of projection portions of the inner sleeve and tapers in a first direction directed toward the front end of the coaxial cable along the coaxial cable, and wherein the shield member of the coaxial cable is sandwiched between the plurality of projection portions of the inner sleeve and the inner peripheral surface of the outer sleeve.

BRIEF DESCRIPTION OF THE DRAWINGS

FIG. 1 is an assembly view of a connector according to an embodiment of the present invention.

FIG. 2 is a cross-sectional view showing the connector according to the embodiment as being attached to a front end of a coaxial cable.

FIG. 3 is a perspective view showing an inner sleeve used in the connector according to the embodiment.

DETAILED DESCRIPTION OF THE INVENTION

Figure 4:
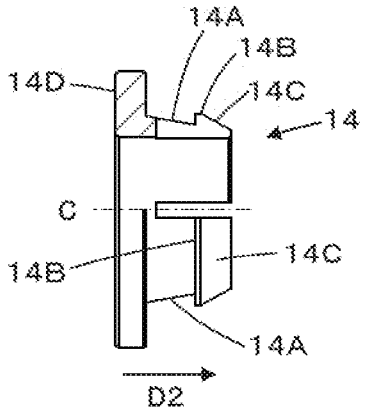
FIG. 4 is a partially broken side view showing the inner sleeve used in the connector according to the embodiment.

An embodiment of the present invention is described below based on the appended drawings.

FIG. 1 is an assembly view of a connector 11 according to the embodiment. The connector 11 is for being attached to a front end 21A of a coaxial cable 21 and has a structure in which a central contact assembly 13, an inner sleeve 14, an outer sleeve 15, a gasket 16 and a clamp nut 17 are sequentially incorporated to a connector body 12 along a central axis C.

The coaxial cable 21 includes a central conductor 22, an insulator 23 that covers an outer periphery of the central conductor 22, a shield member 24 that covers an outer periphery of the insulator 23 and a casing 25 that covers an outer periphery of the shield member 24.

For convenience, a direction along the coaxial cable 21 toward the front end 21A of the coaxial cable 21 is called "first direction D1," whereas a direction opposite from the first direction D1 is called "second direction D2."

FIG. 2 illustrates the connector 11 as being attached to the front end 21A of the coaxial cable 21.

As illustrated in FIG. 2, the connector body 12 is a tubular member formed of a conductive material such as metal, and inside the connector body 12, a central contact accommodation portion 12A is formed on the first direction D1 side while a coaxial cable accommodation portion 12B having a diameter larger than that of the central contact accommodation portion 12A is formed on the second direction D2 side.

In addition, an annular projection portion 12C is formed on an inner peripheral surface of the connector body 12 at an intermediate portion of the central contact accommodation portion 12A in the length direction along the central axis C so as to project toward the central axis C, and an annular abutment surface 12D facing in the second direction D2 is formed at a boarder between the central contact accommodation portion 12A and the coaxial cable accommodation portion 12B. Moreover, a female screw portion 12E is formed on an inner peripheral surface of the connector body 12 at an end portion in the second direction D2 of the connector body 12.

The central contact assembly 13 includes a central contact 13A formed of a conductive material such as metal and extending linearly along the central axis C, and a central contact holder 13B in a cylindrical shape formed of an insulation material and for holding the central contact 13A. The central contact 13A penetrates through a through-hole formed in the central contact holder 13B along the central axis C, with an end portion thereof in the first direction D1 and the other end portion thereof in the second direction D2 each protruding from the central contact holder 13B.

At the end portion in the second direction D2 of the central contact 13A, a central conductor accommodation hole 13C extending along the central axis C and opening in the second direction D2 is formed, and an opening portion 13D communicating with the central conductor accommodation hole 13C and opening in a direction perpendicular to the central axis C is formed.

The central contact assembly 13 is accommodated in the central contact accommodation portion 12A of the connector body 12, having a periphery in the first direction D1 of the central contact holder 13B in contact with the annular projection portion 12C of the connector body 12. An end portion of the central conductor 22 of the coaxial cable 21 is accommodated in the central conductor accommodation hole 13C of the central contact 13A and is soldered through the opening portion 13D, whereby the central contact 13A is connected to the central conductor 22 of the coaxial cable 21.

The inner sleeve 14 is an annular member formed of a conductive material such as metal and includes four cantilever-shaped spring portions 14A arranged in a circumferential direction and each extending in the second direction D2 along the central axis C as illustrated in FIGS. 3 and 4. Each of the spring portions 14A is provided with a projection portion 14B projecting outward in the radial direction. The projection portions 14B are disposed at equal intervals on a predetermined circumference of a circle whose center is the central axis C and are each configured to be elastically displaceable in the radial direction due to the corresponding spring portion 14A. Furthermore, each of the projection portions 14B has a slanted surface 14C that faces outward in the radial direction such that an amount of projection in the radial direction becomes smaller toward the second direction D2.

The inner sleeve 14 is also provided with an annular flange 14D that is disposed ahead of the four projection portions 14B in the first direction D1 and overhangs outward in the radial direction.

The inner sleeve 14 has an inside diameter slightly larger than an outside diameter of the insulator 23 of the coaxial cable 21 and, as illustrated in FIG. 2, is accommodated in the coaxial cable accommodation portion 12B of the connector body 12 in such a manner that a surface facing in the first direction D1 of the flange 14D comes into contact with the abutment surface 12D of the connector body 12, with the central conductor 22 and the insulator 23 of the coaxial cable 21 passing through the inner sleeve 14 and the four projection portions 14B being inserted between the insulator 23 and the shield member 24 of the coaxial cable 21.

Figure 5:
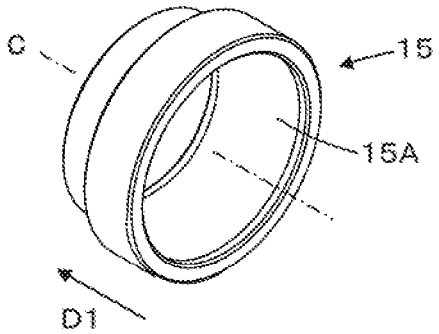
FIG. 5 is a perspective view showing an outer sleeve used in the connector according to the embodiment.
Figure 6:
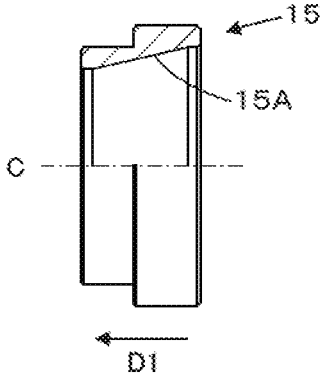
FIG. 6 is a partially broken side view showing the outer sleeve used in the connector according to the embodiment.

The outer sleeve 15 is an annular member formed of a conductive material such as metal and has a conical inner peripheral surface 15A that tapers in the first direction D1 as illustrated in FIGS. 5 and 6. An inside diameter of the inner peripheral surface 15A at one end portion in the second direction D2 is designed to be larger than an outside diameter of the casing 25 of the coaxial cable 21, while an inside diameter of the inner peripheral surface 15A at the other end portion in the first direction D1 is designed to be smaller than the inside diameter at the one end portion in the second direction D2 and larger than the inside diameter of the inner sleeve 14.

As illustrated in FIG. 2, the outer sleeve 15 is accommodated in the coaxial cable accommodation portion 12B of the connector body 12, with the central conductor 22, the insulator 23 and the shield member 24 of the coaxial cable 21 passing through the outer sleeve 15 and the four projection portions 14B of the inner sleeve 14 being covered by the inner peripheral surface 15A. In addition, the shield member 24 of the coaxial cable 21 is sandwiched between the four projection portions 14B of the inner sleeve 14 and the inner peripheral surface 15A of the outer sleeve 15.

The gasket 16 is an annular member formed of an elastic material and is configured to be elastically deformable under compression. The gasket 16 is disposed so as to surround an outer periphery of the casing 25 of the coaxial cable 21.

The clamp nut 17 is a tubular member formed of a conductive material such as metal and has a cylindrical portion 17A that is inserted into the coaxial cable accommodation portion 12B of the connector body 12, and a male screw portion 17B corresponding to the female screw portion 12E of the connector body 12 is formed on an outer periphery of the cylindrical portion 17A. The clamp nut 17 is also provided with a flange 17C disposed at an end portion in the second direction D2 of the cylindrical portion 17A and overhanging outward in the radial direction.

The clamp nut 17 has an inside diameter slightly larger than the outside diameter of the casing 25 of the coaxial cable 21. The cylindrical portion 17A is inserted in the coaxial cable accommodation portion 12B of the connector body 12 with the coaxial cable 21 passing through the clamp nut 17, while the male screw portion 17B is screwed to the female screw portion 12E of the connector body 12, whereby the clamp nut 17 is held by the connector body 12.

When the clamp nut 17 is rotated around the central axis C by means of the flange 17C so that the clamp nut 17 advances in the first direction D1, the outer sleeve 15 is pressed in the first direction D1 via the gasket 16, and the shield member 24 of the coaxial cable 21 sandwiched between the four projection portions 14B of the inner sleeve 14 and the inner peripheral surface 15A of the outer sleeve 15 is sandwiched between a surface facing in the second direction D2 of the flange 14D of the inner sleeve 14 and an end surface facing in the first direction D1 of the outer sleeve 15, whereby the coaxial cable 21 is held by the connector 11.

At this time, the central conductor 22 of the coaxial cable 21 is electrically connected to the central contact 13A of the central contact assembly 13, and the shield member 24 of the coaxial cable 21 is electrically connected to the connector body 12 via the flange 14D of the inner sleeve 14.

Figure 7:
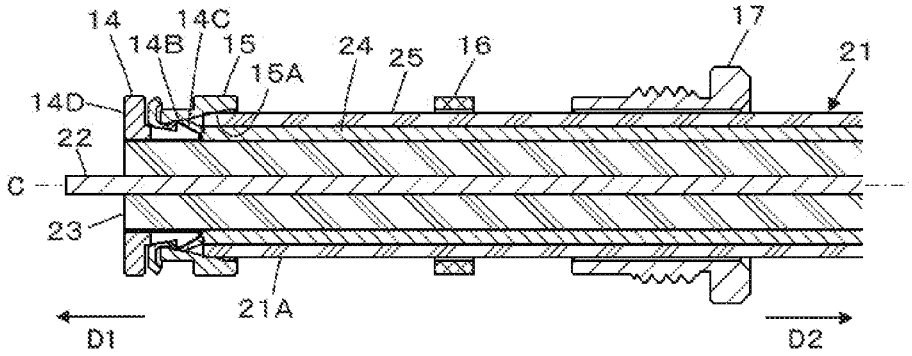
FIG. 7 is a cross-sectional view showing the connector according to the embodiment in a state to be attached to the front end of the coaxial cable.

For attachment of the connector 11 to the front end 21A of the coaxial cable 21, firstly, as illustrated in FIG. 7, the coaxial cable 21 is passed through the clamp nut 17 and the gasket 16, and a portion of the casing 25 with a predetermined length from the end portion in the first direction D1 of the coaxial cable 21 along the central axis C is removed so that the shield member 24 of the coaxial cable 21 is exposed. Moreover, the front end 21A of the coaxial cable 21 with the shield member 24 being exposed is passed through the outer sleeve 15, and the outer sleeve 15 is disposed such that the inner peripheral surface 15A comes into contact with the end portion in the first direction D1 of the casing 25.

Next, the four projection portions 14B of the inner sleeve 14 are inserted between the insulator 23 and the shield member 24 of the coaxial cable 21 from the end portion in the first direction D1 of the coaxial cable 21, and, in this state, the inner sleeve 14 is pressed in the second direction D2. When the inner sleeve 14 moves in the second direction D2 in this manner, the slanted surfaces 14C of the four projection portions 14B of the inner sleeve 14 come into contact with an edge portion in the first direction D1 of the inner peripheral surface 15A of the outer sleeve 15 via the shield member 24 of the coaxial cable 21.

The outside diameter of the shield member 24 disposed on an outer periphery of the four projection portions 14B of the inner sleeve 14, that is, a value obtained by adding a value twice as much as a thickness of the shield member 24 sandwiched between the inner sleeve 14 and the outer sleeve 15 to a diameter of a circle whose center is the central axis C and along which the four projection portions 14B are disposed, is larger than the inside diameter of the inner peripheral surface 15A of the outer sleeve 15 at the end portion in the first direction D1.

Accordingly, when the inner sleeve 14 is further pressed in the second direction D2, the slanted surfaces 14C of the projection portions 14B of the inner sleeve 14 each receive a reaction force exerted in a direction toward the central axis C from the edge portion in the first direction D1 of the inner peripheral surface 15A of the outer sleeve 15 so that at least one of the four spring portions 14A of the inner sleeve 14 elastically deforms toward the central axis C, whereby the four projection portions 14B of the inner sleeve 14 pass over the edge portion in the first direction D1 of the inner peripheral surface 15A of the outer sleeve 15. Accordingly, the four projection portions 14B of the inner sleeve 14 come inside the inner peripheral surface 15A of the outer sleeve 15, and the spring portion 14A that has elastically deformed then returns to the original state. The four projection portions 14B of the inner sleeve 14 are thus covered by the inner peripheral surface 15A of the outer sleeve 15.

At this time, using the surface facing in the first direction D1 of the flange 14D of the inner sleeve 14 as a guide, the insulator 23 of the coaxial cable 21 is cut and a portion of the insulator 23 on the first direction D1 side is removed, whereby the central conductor 22 protruding in the first direction D1 can be exposed as illustrated in FIG. 7.

Figure 8:
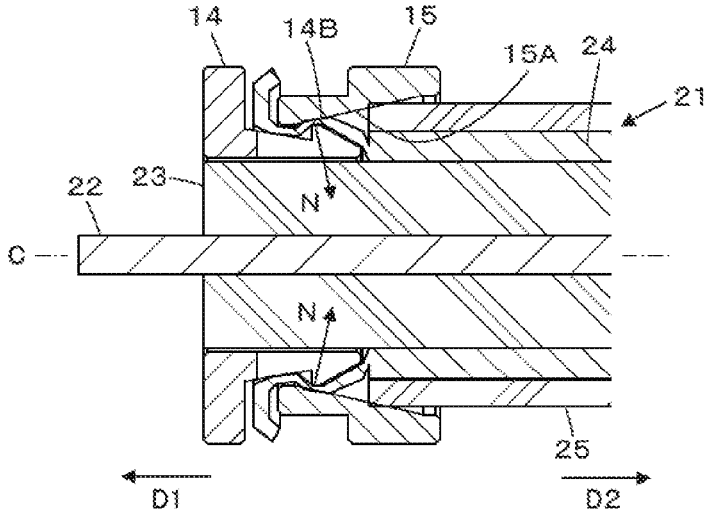
FIG. 8 is an enlarged cross-sectional view of a main part of FIG. 7.

Here, the shield member 24 of the coaxial cable 21 is sandwiched between the four projection portions 14B of the inner sleeve 14 and the inner peripheral surface 15A of the outer sleeve 15. Since the inner peripheral surface 15A of the outer sleeve 15 has a shape of a conical surface tapering in the first direction D1, as illustrated in FIG. 8, a perpendicular reaction force N having a force component exerted toward the second direction D2 acts from the inner peripheral surface 15A of the outer sleeve 15 on each of the projection portions 14B of the inner sleeve 14. Hence, the inner sleeve 14 with the four projection portions 14B being inserted between the insulator 23 and the shield member 24 of the coaxial cable 21 is prevented from falling off from the coaxial cable 21 in the first direction D1 during a process for attachment of the connector 11.

In this state, the central conductor 22 of the coaxial cable 21 protruding in the first direction D1 is inserted in the central conductor accommodation hole 13C of the central contact 13A of the central contact assembly 13 and is soldered through the opening portion 13D, whereby the central conductor 22 of the coaxial cable 21 can be connected to the central contact 13A. In this process, as described above, since the shield member 24 of the coaxial cable 21 is sandwiched between the four projection portions 14B of the inner sleeve 14 and the inner peripheral surface 15A of the outer sleeve 15 and the four projection portions 14B of the inner sleeve 14 are covered by the inner peripheral surface 15A of the outer sleeve 15 so that the inner sleeve 14 is prevented from falling off from the coaxial cable 21 in the first direction D1, connection between the central conductor 22 of the coaxial cable 21 and the central contact 13A can be efficiently performed.

Figure 9:
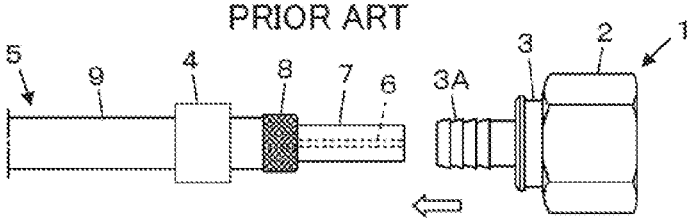
FIG. 9 PRIOR ART
FIG. 9 is a side view showing a conventional connector in a state to be attached to a coaxial cable.
Figure 10:
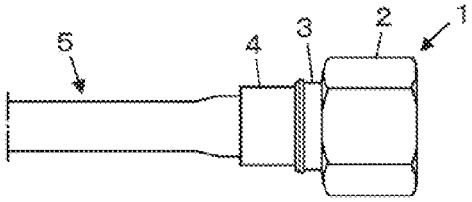
FIG. 10 PRIOR ART
FIG. 10 is a side view showing the conventional connector attached to the coaxial cable.

In case where the shield member 24 is made of an elastic braid such that the coaxial cable 21 can resist repetition of bending motions for use in a robot or the like, the connector having a conventional structure as illustrated in FIGS. 9 and 10 suffers from a problem that, particularly, a connector component readily falls off from the coaxial cable 21. On the contrary, the connector 11 according to the above-described embodiment can be securely attached also to the coaxial cable 21 having the shield member 24 made of an elastic braid.

Accordingly, when the central contact 13A of the central contact assembly 13 is connected to the central conductor 22 of the coaxial cable 21, the central contact assembly 13 is inserted into the central contact accommodation portion 12A of the connector body 12 from the end portion in the second direction D2 of the connector body 12, and the front end 21A of the coaxial cable 21 is accommodated in the coaxial cable accommodation portion 12B of the connector body 12 in such a manner that the surface facing in the first direction D1 of the flange 14D of the inner sleeve 14 comes into contact with the abutment surface 12D of the connector body 12. Moreover, the gasket 16 and the cylindrical portion 17A of the clamp nut 17 through which the coaxial cable 21 is passed are inserted in the coaxial cable accommodation portion 12B of the connector body 12, and the clamp nut 17 is rotated around the central axis C to have the male screw portion 17B of the clamp nut 17 screwed to the female screw portion 12E of the connector body 12, whereby attachment of the connector 11 to the coaxial cable 21 can be completed.

If the clamp nut 17 is screwed into the connector body 12 tightly, the gasket 16 disposed between the outer sleeve 15 and the clamp nut 17 is compressed in the first direction D1 and elastically deforms, thereby sealing between the inner peripheral surface of the coaxial cable accommodation portion 12B of the connector body 12 and the outer peripheral surface of the casing 25 of the coaxial cable 21. In this manner, water proof properties between the coaxial cable 21 and the connector 11 is assured, and, in addition, the clamp nut 17 screwed into the connector body 12 can be prevented from unfastening.

Meanwhile, if water proof properties and prevention of unfastening of the clamp nut 17 are not required, the gasket 16 may be omitted, and the connector may be configured such that the clamp nut 17 directly contacts the outer sleeve 15.

In the connector 11 having such configuration, with the four projection portions 14B of the inner sleeve 14 and the inner peripheral surface 15A of the outer sleeve 15 sandwiching the shield member 24 of the coaxial cable 21 therebetween, the inner sleeve 14 and the outer sleeve 15 can be held with respect to the coaxial cable 21 without depending on lengths of the inner sleeve 14, the outer sleeve 15 and the shield member 24 of the coaxial cable 21 along the central axis C. Therefore, the connector 11 can be decreased in size.

In the above-described embodiment, the four projection portions 14B of the inner sleeve 14 are respectively formed at the four spring portions 14A and thus are configured to be each elastically displaceable in the radial direction. However, this is not the sole case. As long as at least one of the projection portions 14B is formed at the corresponding spring portion 14A and is elastically displaceable in the radial direction, when the inner sleeve 14 is pressed in the second direction D2 with the four projection portions 14B being inserted between the insulator 23 and the shield member 24 of the coaxial cable 21, the four projection portions 14B of the inner sleeve 14 can pass over the edge portion in the first direction D1 of the inner peripheral surface 15A of the outer sleeve 15 to be located inside the inner peripheral surface 15A of the outer sleeve 15.

Moreover, the number of the projection portions 14B of the inner sleeve 14 is not particularly limited to four; as long as the inner sleeve 14 includes two or more projection portions 14B, the inner sleeve 14 and the outer sleeve 15 can be held with respect to the coaxial cable 21 with the projection portions 14B and the inner peripheral surface 15A of the outer sleeve 15 sandwiching the shield member 24 of the coaxial cable 21 therebetween, and, accordingly, the connector 11 that is small in size, that does not readily fall off during the attachment process and that can be securely attached to the front end 21A of the coaxial cable 21 can be realized.

What is claimed is:

1. A connector that is attached to a front end of a coaxial cable, the coaxial cable including a central conductor, an insulator covering an outer periphery of the central conductor and a shield member covering an outer periphery of the insulator, comprising:

an inner sleeve through which the central conductor and the insulator of the coaxial cable are passed; and an outer sleeve through which the central conductor, the insulator and the shield member of the coaxial cable are passed, wherein the inner sleeve includes a plurality of projection portions that are arranged in a circumferential direction, project outward in a radial direction and are inserted between the insulator and the shield member of the coaxial cable, and at least one of the plurality of projection portions is elastically displaceable in the radial direction, wherein the outer sleeve includes an inner peripheral surface that covers the plurality of projection portions of the inner sleeve and tapers in a first direction directed toward the front end of the coaxial cable along the coaxial cable, and wherein the shield member of the coaxial cable is sandwiched between the plurality of projection portions of the inner sleeve and the inner peripheral surface of the outer sleeve.

2. The connector according to claim 1, wherein each of the plurality of projection portions of the inner sleeve is elastically displaceable in the radial direction.

3. The connector according to claim 1, wherein the plurality of projection portions of the inner sleeve are disposed at equal intervals on a predetermined circumference of a circle whose center is the central conductor of the coaxial cable.

4. The connector according to claim 1, wherein each of the plurality of projection portions of the inner sleeve has a slanted surface that is so slanted that an amount of projection of the projection portion in the radial direction becomes smaller toward a second direction opposite from the first direction.

5. The connector according to claim 1, wherein the inner sleeve is formed of a conductive material and has a flange disposed ahead of the plurality of projection portions in the first direction and overhanging outward in the radial direction, and wherein the shield member of the coaxial cable is electrically connected to the inner sleeve through contact with the flange.

6. The connector according to claim 5, wherein the shield member of the coaxial cable is sandwiched and held between a surface, facing in a second direction opposite from the first direction, of the flange of the inner sleeve and an end surface, facing in the first direction, of the outer sleeve.

7. The connector according to claim 1, comprising:

a connector body in a tubular shape accommodating the inner sleeve and the outer sleeve and including an abutment surface which faces in a second direction opposite from the first direction and on which the inner sleeve abuts;

a central contact that is held in the connector body and electrically connected to the central conductor of the coaxial cable; and a clamp nut that is screwed to the connector body to thereby press the outer sleeve in the first direction.

8. The connector according to claim 1, wherein the shield member of the coaxial cable is made of an elastic braid.

* * * * *